US007717769B2

(12) United States Patent
Ohnishi

(10) Patent No.: US 7,717,769 B2
(45) Date of Patent: May 18, 2010

(54) MANUFACTURE OF LAPPING BOARD

(76) Inventor: Kazumasa Ohnishi, 121-35, Hanazonohigashi 2-chome, Nagaoka-shi, Niigata (JP) 940-0846

( * ) Notice: Subject to any disclaimer, the term of this patent is extended or adjusted under 35 U.S.C. 154(b) by 95 days.

(21) Appl. No.: 11/948,635

(22) Filed: Nov. 30, 2007

(65) Prior Publication Data

US 2008/0287042 A1 Nov. 20, 2008

Related U.S. Application Data

(62) Division of application No. 10/852,145, filed on May 25, 2004, now Pat. No. 7,303,599.

(30) Foreign Application Priority Data

May 26, 2003 (JP) ..... 2003-148163

(51) Int. Cl.
*B24B 1/00* (2006.01)

(52) U.S. Cl. ..... 451/41; 451/36; 451/54; 451/56; 451/910

(58) Field of Classification Search ..... 451/28, 451/36, 41, 54, 56, 285, 287, 165, 910; 51/293; 76/101.1
See application file for complete search history.

(56) References Cited

U.S. PATENT DOCUMENTS

| | | | |
|---|---|---|---|
| 5,575,707 | A | 11/1996 | Talieh et al. |
| 6,146,250 | A | 11/2000 | Nagabushnam et al. |
| 6,368,193 | B1 | 4/2002 | Carlson et al. |
| 6,913,528 | B2 | 7/2005 | Schulz et al. |
| 2004/0137830 | A1 | 7/2004 | Ohnishi |

FOREIGN PATENT DOCUMENTS

| | | | |
|---|---|---|---|
| JP | 64-061397 | A | 3/1989 |
| JP | 04-132691 | A | 5/1992 |
| JP | 07-299737 | | 11/1995 |
| JP | 07-299737 | A | 11/1995 |
| JP | 09-201761 | A | 8/1997 |
| JP | 10-249714 | A | 9/1998 |

*Primary Examiner*—Eileen P. Morgan
(74) *Attorney, Agent, or Firm*—Nixon Peabody LLP; Jeffrey L. Costellia

(57) ABSTRACT

A method for manufacturing a lapping board having abrasive grains fixed on its surface, which is performed by the steps of: preparing a rotatable metal board having a surface of soft metal, an abrasive slurry-supplying tool arranged over the surface of the metal board, an abrasive-pressing tool which is placed on the metal board and has a hard surface, and a ultrasonic oscillation-generating tool attached to either or both of the abrasive-pressing tool and the metal board; rotating the metal board while supplying an abrasive slurry onto the surface of the metal board and while supplying electric power to the ultrasonic oscillation-generating tool to generate and apply ultrasonic oscillation to either or both of the abrasive-pressing tool and the metal board, whereby introducing the supplied abrasive slurry between the metal board and the abrasive-pressing tool and partly embedding some abrasive grains onto the metal board; and removing unfixed abrasive grains from the metal board.

9 Claims, 7 Drawing Sheets

MANUFACTURE OF LAPPING BOARD

Parent Data Ser. No. 11/948,635, filed Nov. 30, 2007 is a division of Ser. No. 10/852,145, filed May 25, 2004, now U.S. Pat. No. 7,303,599 claims foreign priority to 2003-148163, filed May 26, 2003.

FIELD OF THE INVENTION

This invention relates to a method of manufacturing a lapping board on which abrasive grains are fixed.

BACKGROUND OF THE INVENTION

A lapping machine is generally employed for lapping accurately a surface of an object such as a silicon substrate to be employed for manufacturing an integrated circuit or an alumina-titanium carbide substrate to be employed for manufacturing a magnetic head.

FIG. 4 is a front view of a typical structure of the conventionally employed lapping machine, and FIG. 5 is a top view of the lapping machine of FIG. 4. The lapping machine of FIGS. 4 and 5 comprises a lapping board 43 which is fixed to an axis of rotation 42 of a motor 41, a abrasive grain-supplying means 45 which supplies a slurry 44 containing abrasive grains on the surface of the lapping board 43, and disc means 47 for rotatably supporting an object 46 to be lapped.

The object 46 is temporarily attached to the supporting means 47 via wax or the like. The supporting means 47 is supported on its circumferential side with a pair of rollers 50. Each roller 50 is rotatably supported by a roller-supporting means 53 which is arranged on the top of a pole 22 standing on a base board 51.

The lapping board 43 rotates in the direction indicated by the arrow 49 (see FIG. 5) by activating the motor 41. With the rotation of the lapping board 43, the supporting means 47 holding the object 46 rotates under guidance with the pair of rollers 50.

On the surface of the lapping board 43, the abrasive grain slurry 44 is dropwise supplied from the abrasive grain-supplying means 45. Abrasive grains generally are diamond grains, alumina grains, or silica grains. The abrasive grain slurry 44 is moved toward the object 46 and supplied between the lapping board 43 and the object 46 by the rotation of the lapping board 43.

The lapping board 43 temporarily holds abrasive grains between the object 46 and the board 43. Thus, the lapping board 43 is generally made of relatively soft material such as tin, as compared with the abrasive grains. For instance, a lapping board made of tin is slightly deformed on its surface to temporarily hold the abrasive grains.

When the lapping board 43 and the object to be lapped 46 are independently rotated with the intervening abrasive grains, the under-surface of the object 46 is polished. The polishing using abrasive grains is generally named "lapping".

JP-7-299737 A describes that the conventionally used lapping method such as that described above sometimes produces unfavorable recesses and scratches on the lapped surface of the object, particularly electric devices having a soft metal area and hard metal area on their surfaces. According to the descriptions, the recesses and scratches are produced mainly by the presence of free abrasive grains unfixed onto the lapping board. Then, this JP publication proposes a lapping method utilizing previously abrasive grain-embedded lapping board which is manufactured by the steps of supplying a slurry of abrasive grains in a liquid medium onto a lapping board, fixing some of the supplied grains onto the lapping board under the partly embedded condition, and removing unfixed abrasive grains from the lapping board.

The above-identified lapping board on which abrasive grains are previously fixed under the partly embedded condition is theoretically satisfactory because the lapping board has no unfixed abrasive grains on its surface.

The present inventor has noted that the manufacturing procedure of the lapping board described in the JP publication has a drawback in that it takes a long period of time to manufacture a lapping board onto which an appropriately great number of abrasive grains are uniformly fixed. Because of this drawbacks, the manufacturing method of JP publication is hardly applicable in industry.

SUMMARY OF THE INVENTION

Accordingly, the present invention has an object to provide a method of manufacturing a lapping board onto which an appropriately great number of abrasive grains are uniformly fixed within a relatively shortened period of time.

The present invention resides in a method for manufacturing a lapping board having abrasive grains fixed thereon, which comprises the steps of:

preparing a rotatable metal board having thereon a surface of soft metal, an abrasive slurry-supplying means arranged over the surface of the metal board, an abrasive-pressing means detachably placed on the surface of the metal board, the abrasive-pressing means having a surface harder than the surface of soft metal, and a ultrasonic oscillation-generating means attached to either or both of the abrasive-pressing means and the metal board;

rotating the metal board while supplying an abrasive slurry in which abrasive grains are suspended in a liquid medium onto the surface of the metal board from the abrasive slurry-supplying means and while supplying electric power to the ultrasonic oscillation-generating means to generate and apply ultrasonic oscillation to either or both of the abrasive-pressing means and the metal board, whereby introducing the supplied abrasive slurry between the soft surface of the metal board and the hard surface of the abrasive-pressing means and fixing some of the abrasive grains onto the soft surface of the metal board under the condition that a portion of the abrasive grain is embedded into the soft surface of the metal board and a remaining portion of the abrasive grain is exposed over the soft surface of the metal board; and removing unfixed abrasive grains from the soft surface of the metal board.

The invention also resides in an apparatus for manufacturing a lapping board having abrasive grains fixed thereon, which comprises a rotatable metal board having thereon a surface of soft metal, an abrasive slurry-supplying means arranging over the surface of the metal board, an abrasive-pressing means detachably placed on the surface of the metal board, the abrasive-pressing means having a surface harder than the surface of soft metal, and a ultrasonic oscillation-generating means attached to either or both of the abrasive-pressing means and the metal board.

Preferred embodiments of the invention are described below.

(1) The abrasive-pressing means is rotatable and rotates on the metal board while the metal board rotates.

(2) The abrasive-pressing means is in the form of a cylinder having the hard surface on a bottom thereof.

(3) The abrasive-pressing means has one or more grooves at periphery of the bottom.

(4) The ultrasonic oscillation-generating means is a Langevin vibrator.

DETAILED DESCRIPTION OF THE INVENTION

The present invention is further described by referring to the figures given in the attached drawings.

Figure 1:
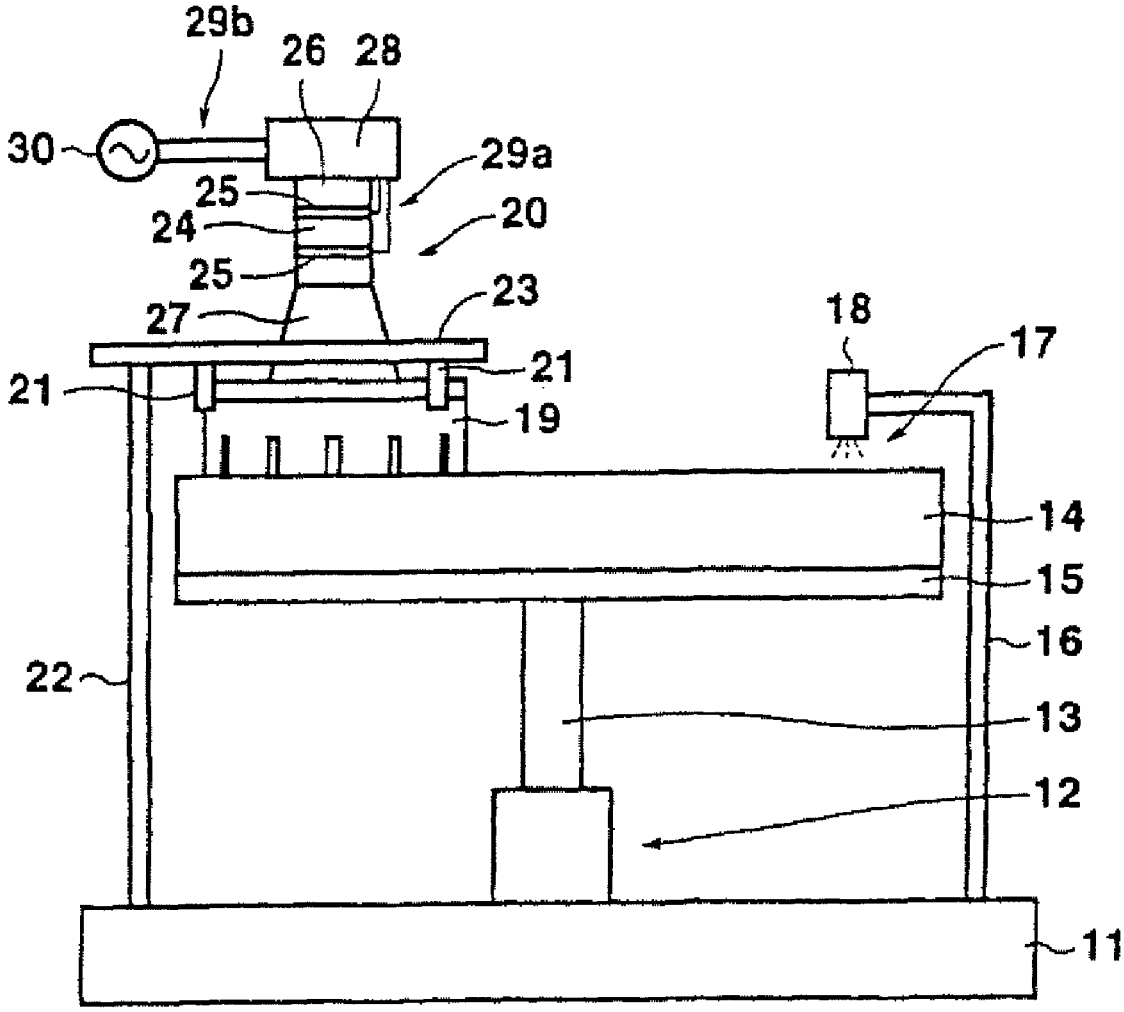
FIG. 1 is a front view of an apparatus for manufacturing a lapping board having abrasive grains fixed on its surface, according to the invention.

The apparatus of FIG. 1 for manufacturing a lapping board according to the invention is composed of a substrate 11, a motor 12 fixed onto the substrate, a rotatable axis 13 connected to the motor, a metal board 14 on which the abrasive grains are to be fixed, a support board 15 which is fixed on the top of the rotatable axis 13, a pole supporting 16 a abrasive slurry-supplying means 18 which supplies an abrasive slurry 17 comprising abrasive grains dispersed in a liquid medium, an abrasive-pressing means 19 which press the supplied abrasive grains onto the metal board 14, and a ultrasonic oscillation-generating means 20 attached to the abrasive-pressing means 19.

When the motor 12 rotates the rotatable axis 13, the metal board 14 rotates, and the abrasive-pressing means 19 equipped with the ultrasonic oscillation-generating means 20 also rotates on the metal board 14 keeping its side face in contact with a pair of rollers 21. The rollers 21 are rotatably attached to a roller-supporting means 23 which is attached to the top of a pole 22 fixed to the substrate 11.

The ultrasonic oscillation-generating means 20 in FIG. 1 is a Langevin vibrator composed of a piezoelectric ceramic disc 24, a pair of electrodes 25 each of which is attached to each surface side of the ceramic disc 24, a pair of metal members 26, 27 each of which is arranged on each outer side of the electrodes, and a bolt (not shown) to firmly combine the structure of metal member/electrode/ceramic disc/electrode/metal member. On the upper surface of the ultrasonic oscillation-generating means is provided a slip ring 28. The piezoelectric vibrator of the ultrasonic oscillation-generating means 20 is a vibrator giving a vertical oscillation. To the electrode 25 of the piezoelectric vibrator is electrically connected an alternating current source 30 through a wiring 29*a*, the slip ring 28, and a wiring 29*b*. When an alternating current is input to the electrode 25 of the vibrator of the ultrasonic oscillation-generating means 20 by the alternating current source 30, the ultrasonic oscillation-generating means 20 generates a ultrasonic oscillation vibrating in the direction perpendicular to the metal board and applies the ultrasonic oscillation to the abrasive-pressing means 19.

Figure 3:
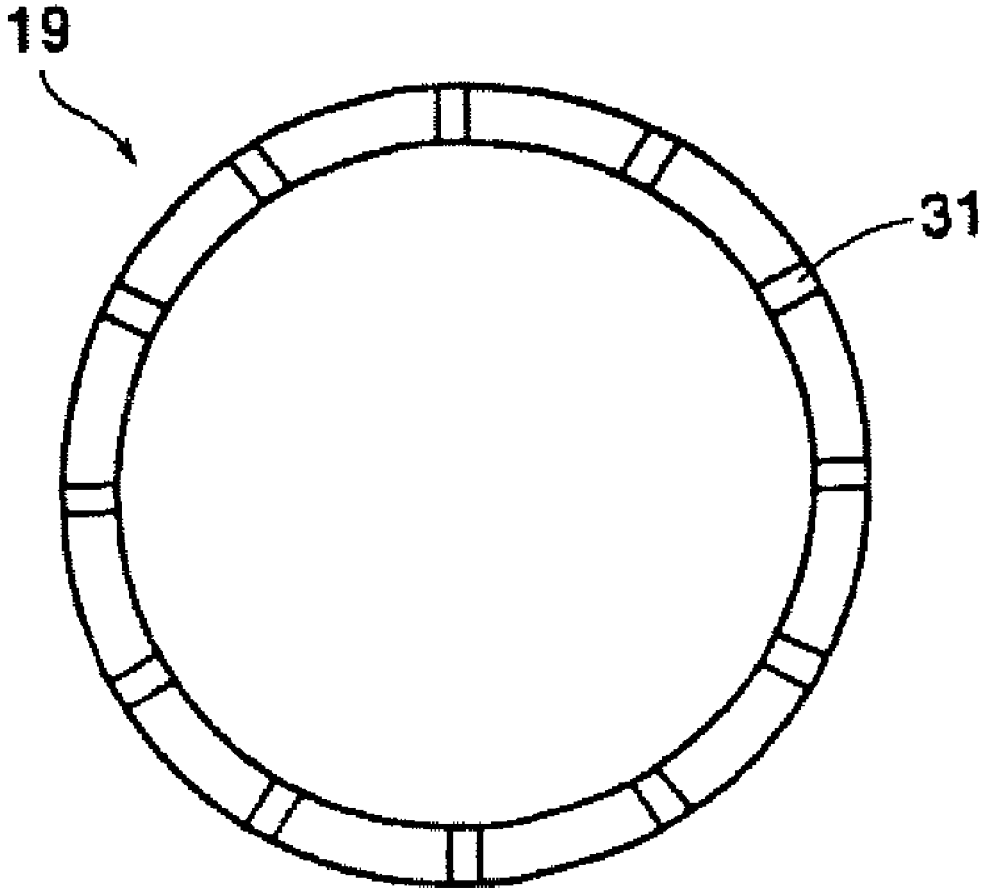
FIG. 3 is a bottom view of the abrasive-pressing means employed in the apparatus of FIG. 1.
Figure 4:
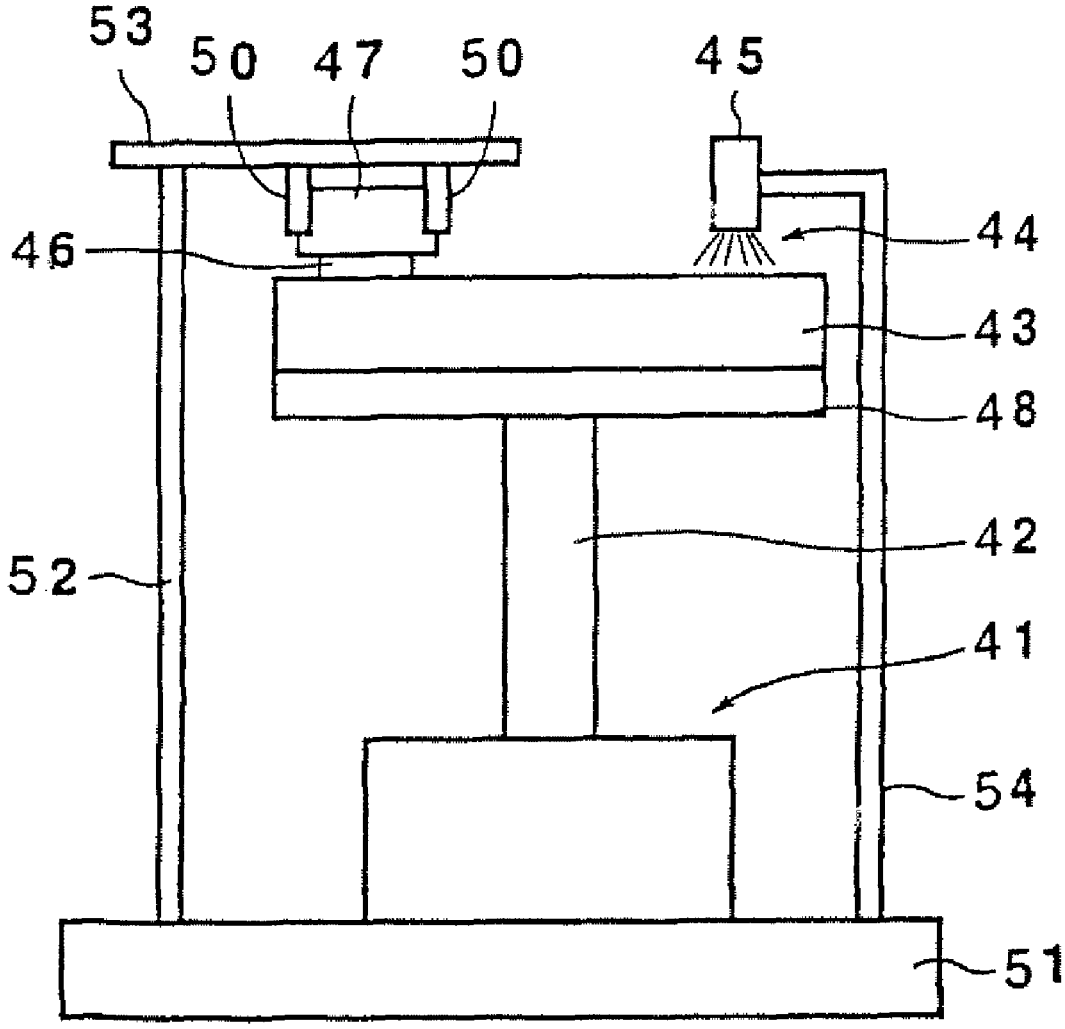
FIG. 4 is a front view of the conventional lapping machine.
Figure 5:
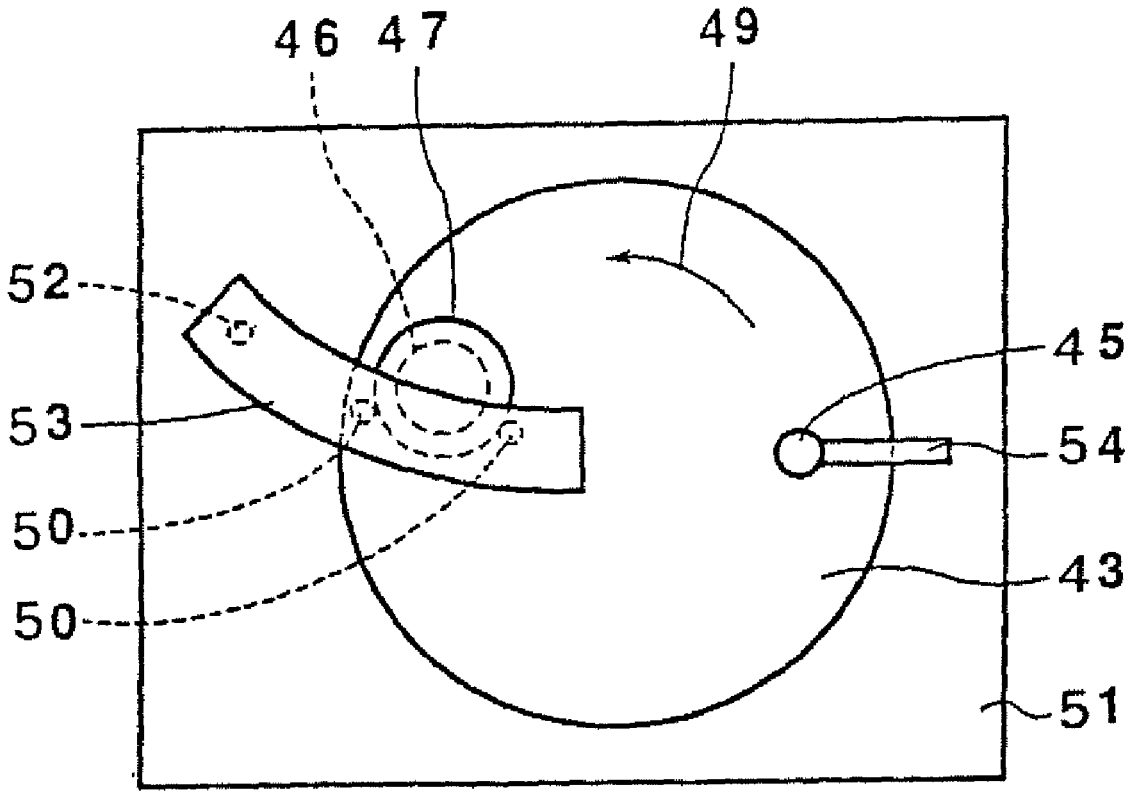
FIG. 5 is a top view of the machine of FIG. 4.

The abrasive-pressing means 19 is made of a hard materials such as aluminum oxide and takes a cylindrical form in FIG. 1. FIG. 3 illustrates a bottom view of the abrasive-pressing means 19. As is seen from FIG. 3, the abrasive-pressing means 19 has a bottom surface at the periphery of which plural grooves 31 are provided.

Although the ultrasonic oscillation-generating means is attached to the abrasive-pressing means in FIG. 1, the ultrasonic oscillation-generating means can be attached to the metal board directly or via the support board. Otherwise, the ultrasonic oscillation-generating means can be attached to both of the abrasive-pressing means and the metal board. One or plural ultrasonic oscillation-generating means can be utilized. The ultrasonic oscillation-generating means is preferably attached to the abrasive-pressing means and/or the metal board via a contact medium such as grease.

The ultrasonic oscillation-generating means can be an electro-strictive vibrator or a magneto-strictive vibrate. An example of the electro-strictive vibrator is the aforementioned Langevin vibrator. An example of the magneto-strictive vibrator is a metal magneto-strictive vibrator or a ferrite vibrator. The electro-strictive vibrator is preferably employed for the purpose of the invention. Most preferred is the Langevin vibrator.

The abrasive-pressing means has a hard surface on its bottom so as to effectively press and partly embed abrasive grains such as diamond grains into the surface of the metal board. Examples of the material of the bottom of the abrasive-pressing means include ceramics such as aluminum oxide, zirconium oxide, silicon nitride, and silicon carbide and ultra-hard alloys such as WC—Ta—Co alloy and WC—TiC—Co alloy. Otherwise, a portion of the bottom of the abrasive-pressing means can be made of the hard material.

Figure 2:
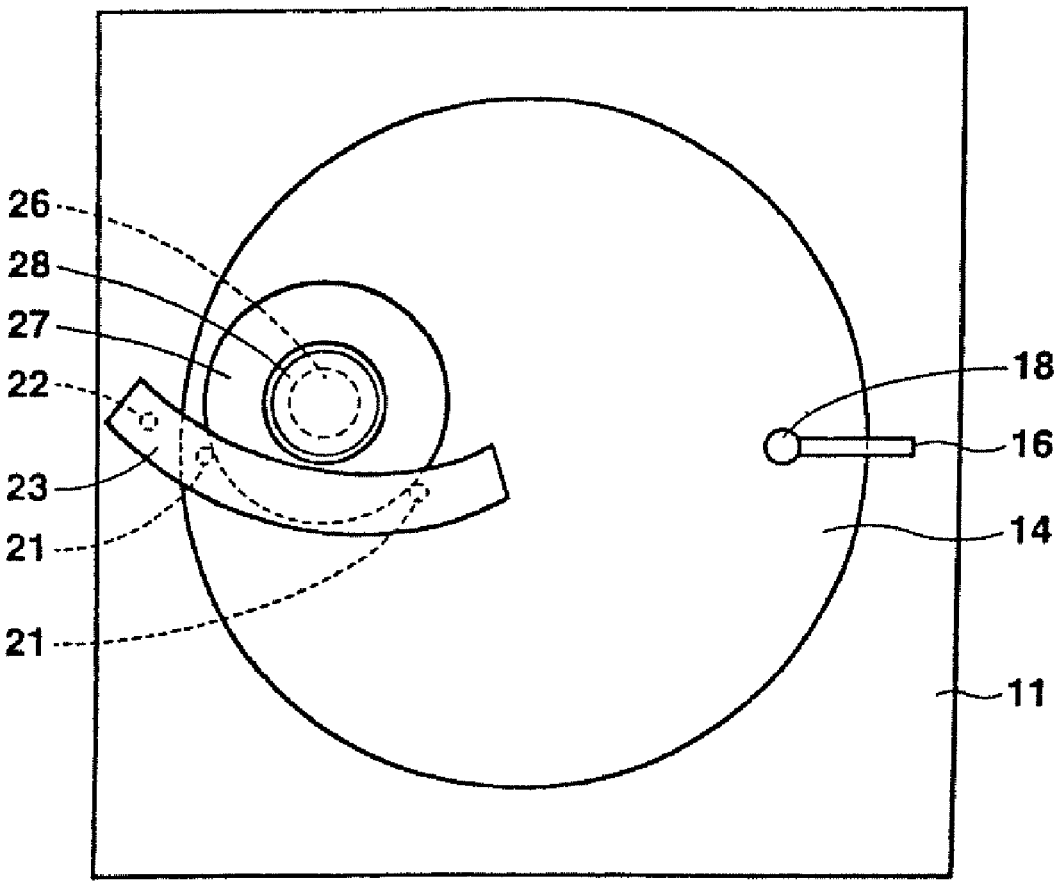
FIG. 2 is a top view of the apparatus of FIG. 1.

The abrasive-pressing means preferably has a cylindrical body as is illustrated in FIGS. 1 to 3, so as to impart uniform pressure onto abrasive grains dispersed under the bottom of the abrasive-pressing means.

The abrasive-pressing means preferably has one or more grooves its the bottom surface, as is illustrated in FIG. 3. The grooves can guide the abrasive grains to spread under the bottom of the abrasive-pressing means.

The metal board for the lapping board has a surface made of a soft metal such as tin, lead, a tin-containing alloy, or a lead-containing alloy. Examples of these alloys include tin-antimony alloy, tin-bismuth alloy, tin-lead alloy, and brass. If desired, the metal board can be replaced with a resin board.

The abrasive grains can be any one of the known abrasive grains. Examples of the abrasive grains are aluminum oxide grains, silicon oxide grains, chromium oxide grains, iron oxide grains, silicon carbide grains, boron nitride grains, and diamond grains. The grain size of the abrasive grain can be in the range of 10 nm to 1 μm. The abrasive grains are chosen in consideration of the kind and nature of the material or device to be lapped using the manufactured lapping board. The abrasive slurry is a dispersion of abrasive grains in a liquid medium such as water or oil such as olive oil, silicone oil or machine oil.

The method of manufacturing the lapping board according to the invention is now described below by referring to the apparatus shown in FIG. 1.

The method of manufacturing the lapping board is performed by the following three steps in sequence.

(1) The apparatus such as that illustrated in FIG. 1 is prepared.

(2) The metal board 14 is rotated and the ultrasonic oscillation-generating means 20 is activated to apply the generated ultrasonic oscillation to the abrasivepressing means 19 which also rotates around its center axis. Simultaneously, an abrasive slurry 17 is supplied onto the surface of the metal board 14 from the abrasive slurry-supplying means 17. The abrasive slurry supplied onto the surface of the metal board 14 then spreads under the bottom of the abrasive-pressing means 19. Most of the abrasive grains under the bottom of the abrasivepressing means 19 are then embedded into the surface of the metal board 14 under the condition that the upper portions are exposed over the surface of the metal board 14.

(3) The abrasive grains which are not embedded and unfixed are then removed.

In the method of manufacturing a lapping board according to the invention, the abrasive grains in the supplied abrasive slurry is pressed onto the surface of the metal board under a pressure supplied by the abrasive-pressing means which vibrates in accordance with the ultrasonic oscillation supplied by the ultrasonic oscillation-generating means. Since the vibration is supplied to the abrasive grains by the abrasive-pressing means, the abrasive grains are easily embedded into the surface of the metal board, and the lapping board can be manufactured within a shorter time, as compared with the case of not utilizing the ultrasonic oscillation.

The lapping board manufactured by the above-mentioned method can be employed for lapping electronic device, electronic parts, or other elements according to the conventional procedure except for replacing the abrasive slurry with a liquid medium containing no abrasive grains. If it is desired to accomplish the lapping within a short period of time, the lapping is preferably performed using a ultrasonic oscillation-generating means. The ultrasonic oscillation-generating means can be attached to the lapping board and/or a means to holding an object to be lapped.

The present invention is further described by the following examples.

EXAMPLE

An apparatus illustrated in the attached FIGS. 1 to 3 was prepared. The metal board 14 had a thickness of 40 mm and a diameter of 380 mm and was made of tin-antimony alloy.

The abrasive-pressing means 19 had a cylindrical body having a outer diameter of 140 mm, an inner diameter of 120 mm, and a height of 40 mm, and was made of aluminum oxide. The abrasive-pressing means 19 had a bottom which had 12 grooves 31 on its periphery, as shown in FIG. 3. Each groove 31 had a width of 5 mm and a depth of 20 mm. The abrasive slurry was a dispersion of diamond abrasive grains (grain size: approx. 0.1 μm) in olive oil.

The ultrasonic oscillation-generating means was a Langevin vibrator, and an oscillation amplitude applied to the abrasive-pressing means was approx. 2 μm.

The procedures according to the method for manufacturing a lapping board were carried out utilizing the above-mentioned apparatus for one hour. After the rotation of the metal board was terminated, the abrasivepressing means was lifted up, and the metal board having abrasive grains embedded on its surface was wiped with a cloth containing ethanol.

Figure 6:
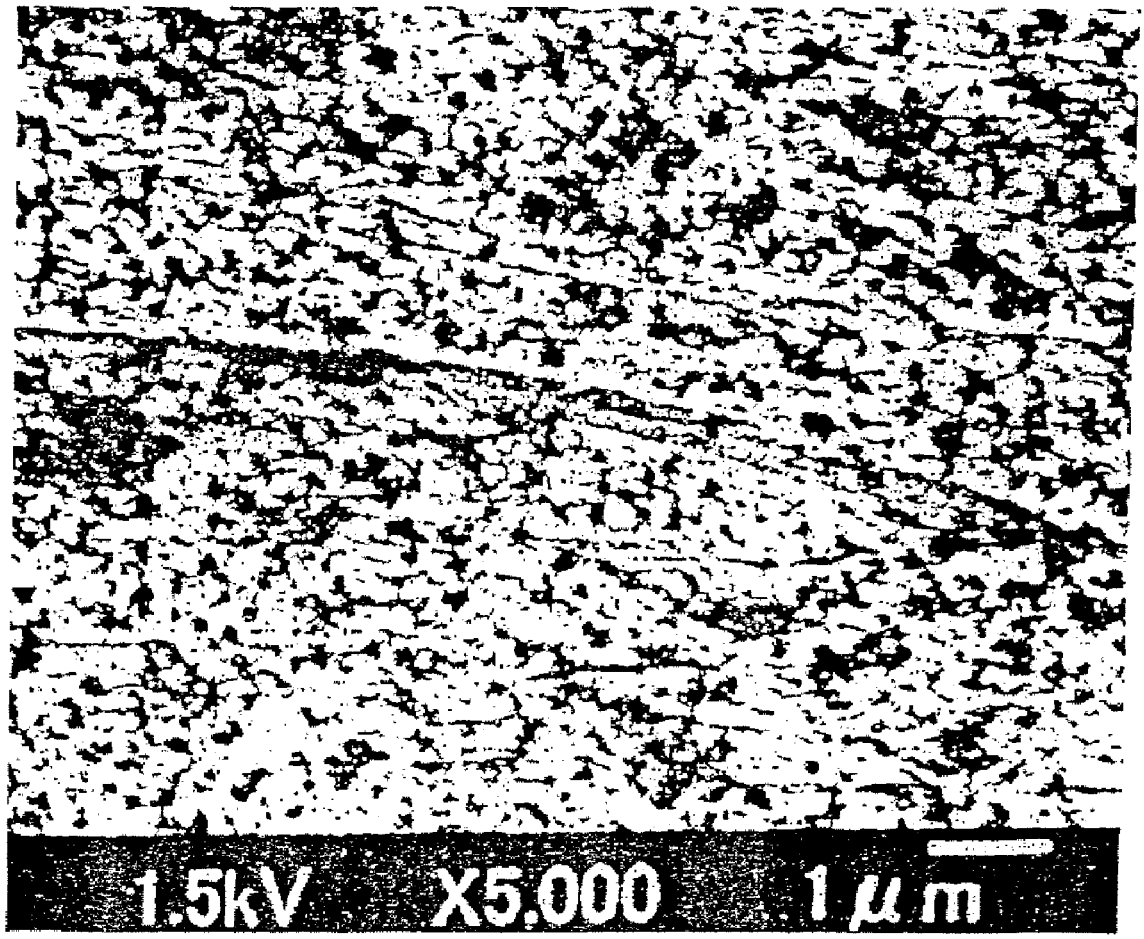
FIG. 6 is an electromicroscopic photograph of the surface of the lapping board manufactured in Example.

FIG. 6 is an electromicroscopic photograph in which the black spots correspond to diamond abrasive grains partly embedded on the surface of the metal board. It is clear that a large number of abrasive grains are fixed.

COMPARISON EXAMPLE

The procedures of the above-mentioned Example were repeated using the same apparatus but no activating the ultrasonic oscillation-generating means.

Figure 7:
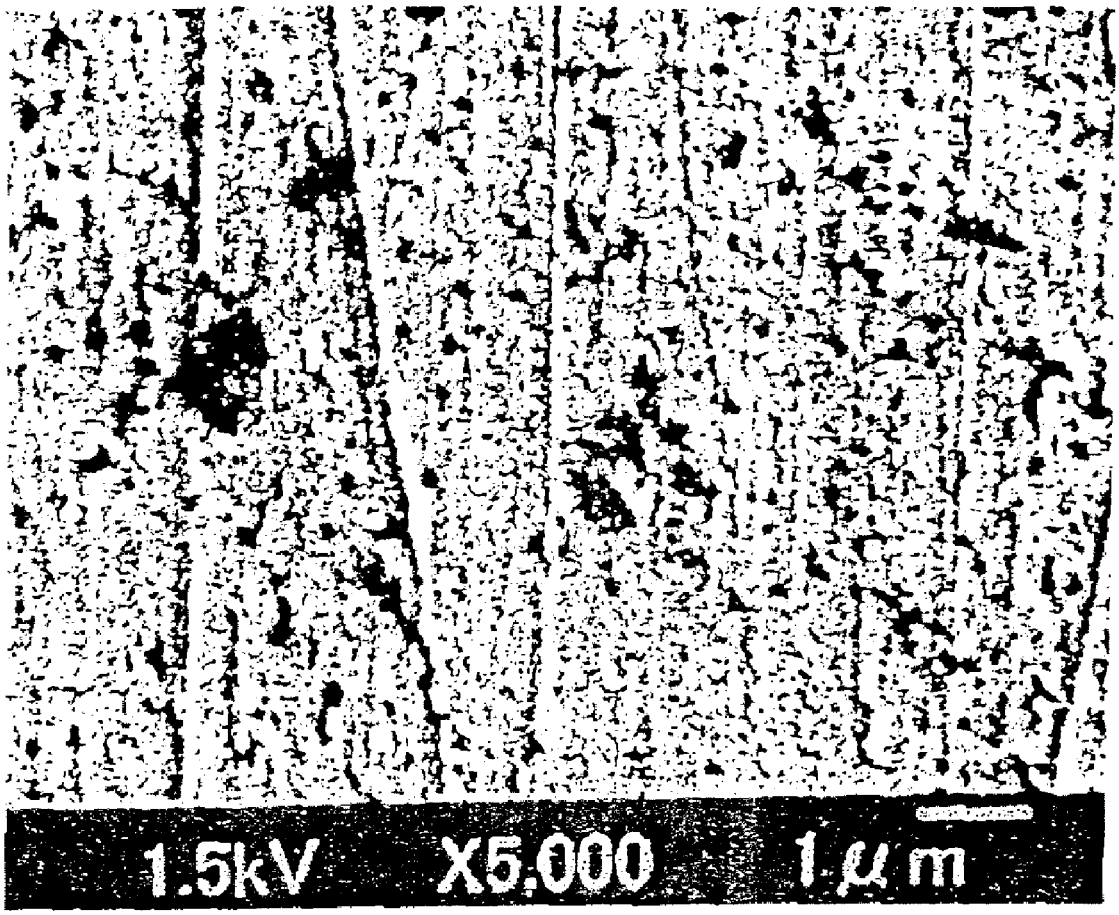
FIG. 7 is an electromicroscopic photograph of the surface of the lapping board manufactured in Comparison Example.

FIG. 7 is an electromicroscopic photograph in which the black spots correspond to diamond abrasive grains partly embedded on the surface of the metal board. It is clear that a relatively small number of abrasive grains only are fixed.

What is claimed is:

1. A method for producing an object lapped on a surface thereof which comprises the steps of:

manufacturing a lapping board having abrasive grains fixed thereon by the steps of:

providing an assembly comprising a rotatable metal board having thereon a surface of soft metal, an abrasive slurry-supplying means arranged over the surface of the metal board, an abrasive-pressing means detachably placed on the surface of the metal board, the abrasive-pressing means having a surface harder than the surface of soft metal, and a ultrasonic oscillation-generating means attached to either or both of the abrasive-pressing means and the metal board;

rotating the metal board of the assembly while supplying an abrasive slurry comprising abrasive grains suspended in a liquid medium onto the surface of the metal board from the abrasive slurry-supplying means and while supplying electric power to the ultrasonic oscillation-generating means to generate and apply ultrasonic oscillation to either or both of the abrasive-pressing means and the metal board, whereby introducing the supplied abrasive slurry between the surface of the metal board and the surface of the abrasive-pressing means and fixing some of the abrasive grains onto the surface of the metal board under the condition that a portion of the abrasive grain is embedded into the surface of the metal board and a remaining portion of the abrasive grain is exposed over the surface of the metal board;

removing unfixed abrasive grains from the surface of the metal board;

placing a holding means having on a bottom thereof an object to be lapped on the lapping board; and rotating the lapping board, thereby lapping the object on a bottom thereof.

2. The method of claim 1, wherein the abrasive-pressing means is rotatable and rotates on the metal board while the metal board rotates.

3. The method of claim 1, wherein the abrasive-pressing means is in the form of a cylinder having the hard surface on a bottom thereof.

4. The method of claim 3, wherein the abrasive-pressing means has one or more grooves at periphery of the bottom.

5. The method of claim 1, wherein the ultrasonic oscillation-generating means is a Langevin vibrator.

6. The method of claim 1, wherein the object to be lapped is rotated independently of the lapping board.

7. The method of claim 1, wherein the step of rotating the lapping board is performed while a slurry comprising abrasive grains in a liquid medium or a liquid medium containing no abrasive grains is supplied onto the lapping board.

8. The method of claim 1, wherein the step of rotating the lapping board is performed while a ultrasonic oscillating is applied to the lapping board or the holding means.

9. The method of claim 1, wherein the object to be lapped is a silicon substrate, an alumina-titanium carbide substrate, or an electronic device.

* * * * *